US005316137A

United States Patent [19]

Kyllonen

[11] Patent Number: 5,316,137

[45] Date of Patent: May 31, 1994

[54] PAINT SAVER TRAY

[76] Inventor: Glenn F. Kyllonen, 14501 Kidston Road, Vernon, British Columbia, Canada, V1B 1R7

[21] Appl. No.: 46,229

[22] Filed: Apr. 13, 1993

[51] Int. Cl.[5] ..... B65D 81/24; A47L 13/56

[52] U.S. Cl. ..... 206/209; 15/257.06; 206/229; 206/361; 220/570; 401/118

[58] Field of Search ..... 206/209, 229, 361; 220/570, 354–356; 15/257.05, 257.06; 401/118, 126, 129

[56] References Cited

U.S. PATENT DOCUMENTS

| | | | |
|---|---|---|---|
| 2,695,645 | 11/1954 | Tupper | 220/354 |
| 3,487,972 | 1/1970 | Swett | 220/355 X |
| 3,885,666 | 5/1975 | Maxwell | 220/355 X |
| 4,228,916 | 10/1980 | Weingardt | 220/354 |
| 4,445,250 | 5/1984 | Seidl | 15/257.06 |
| 4,541,542 | 9/1985 | Florentino | 401/118 X |
| 4,547,926 | 10/1985 | Kern | 15/257.06 |
| 4,549,562 | 10/1985 | Ossi | 15/257.06 X |
| 4,651,379 | 3/1987 | Kern | 15/257.06 |

*Primary Examiner*—Bryon P. Gehman

*Attorney, Agent, or Firm*—Baker, Maxham, Jester & Meador

[57] ABSTRACT

A paint roller tray and lid having a seal for resealable air-tight mating of the tray with the lid. The lid has a paint roller handle holder so that when the lid is mated onto the tray the paint roller handle is detachably securable to the lid. The holder for holding a paint roller handle has a pair of resilient protrusions depending from the interior of the paint roller handle housing of the lid, the protrusions being in spaced apart relation so as to snugly receive therebetween a paint roller handle. The housing has contiguous sides extending upward from the upper surface of the lid and a roof extending between the contiguous sides. The protrusions depend from the roof into the housing, each of the resilient protrusions having therein a finger or thumb receptacle for insertion of a finger or thumb into the receptacle from the top of the housing whereby when a finger and a thumb are placed into the receptacles and a paint roller handle is detachably secured between the protrusions, the protrusions may be resiliently deformed so as to grip the paint roller handle between the protrusions.

1 Claim, 3 Drawing Sheets

PAINT SAVER TRAY

FIELD OF THE INVENTION

The present invention relates to the field of trays and like containers for holding paint or like fluids wherein the trays are adapted for use in association with roller applicators of the type which typically have an applicator sleeve which slides over a cylindrical frame rotatably mounted on a handle which extends at right angles to the applicator sleeve.

BACKGROUND OF THE INVENTION

A paint roller is a very common tool used by professionals and non-professionals such as home owners who do their own renovations. Paint rollers are convenient in that they cover a greater area in one stroke than typically do paint brushes.

Paint rollers typically have a paint applicator sleeve which fits over a cylindrical frame rotatably mounted on a handle which extends at right angles to the applicator sleeve. The handle extends through the rotatably mounted cylindrical frame to serve as the axle on which the frame rotates. The handle is bent or curved so as to double back upon itself along approximately half the length of the applicator sleeve so that the handle may extend at right angles to the applicator sleeve from approximately the half-way point along the applicator sleeve.

When applying paint to the applicator sleeve, it is desirable that only the outer surface of the sleeve come into contact with the paint. Consequently, a typical paint roller paint tray will be generally rectangular with a shallow trough at one end and an upwardly gently sloping surface extending upwardly from the trough along the remaining length of the tray.

Paint is poured from storage cans into the trough and applied to the applicator sleeve by dipping the sleeve surface into the paint and rolling the paint roller along the upwardly gently sloping surface of the tray.

It frequently happens that the amount of paint poured from a storage can into the trough is in excess of what is required to complete the paint job, or it is otherwise desirable to interrupt painting so that paint is left in the trough in the paint tray. It is bad practice to pour leftover paint left in the trough in the paint tray back into the storage cans. If this is done, a screened funnel is used to prevent introduction of contaminants into the otherwise clean paint stored in the storage cans. This means that excess paint has to be discarded before it starts to dry in the paint roller tray and makes cleaning of the paint roller tray difficult.

Quite often, painters who paint for a living find it convenient to leave paint in the paint roller trays for extended periods. What is sometimes done is that the paint roller tray containing the paint is slid into a plastic bag or the like and the bag is sealed so that the paint does not dry out as rapidly. This technique has obvious drawbacks in that it is clumsy and can be messy.

Painters would find it convenient to transport the paint roller trays containing the paint with the paint rollers actually left in the paint tray while the tray is being transported or stored. With conventional paint roller trays this would have its' obvious disadvantages in that paint will typically move around inside the paint tray and thus the paint roller handle will become splattered in paint.

It is an object of this invention to provide a paint roller tray having a closely fitting, reusable lid so that paint may be left for extended periods of time in the tray without drying out.

It is a further object of this invention to provide a paint roller tray reusable lid which is adapted to grip the handle of a paint roller so as to prevent the handle dropping into the tray.

SUMMARY OF THE INVENTION

The paint tray of the present invention has two parts, namely; a paint roller tray having a raised flange around the circumference and extending upwardly from the paint roller tray sidewalls; and, a sealable reusable lid for the paint roller tray having a corresponding groove in the lid for sealable mating with the raised flange on the paint roller tray.

The paint roller tray has the same elements as a conventional paint roller tray, namely; a trough at one end for storing paint, and an upwardly gently sloping surface extending along the tray upwardly from the trough. In addition, the tray of the present invention in its' preferred embodiment has a ridge extending across the trough, approximately bisecting the trough, and a raised ledge at the end of the tray opposed to the trough for supporting the handle of a paint roller above the surface of the gently upwardly sloping surface.

The sealable, reusable lid has a raised paint roller handle housing extending above the lid surface which forms a cavity above the gently upwardly sloping surface of the paint roller tray when the lid is mated thereon. The paint roller handle housing incorporates means for gripping a paint roller handle which, in the preferred embodiment, are formed from two columnar protrusions extending from the top of the housing into the cavity formed by the housing. The protrusions are space sufficiently widely apart so as to grip a paint roller handle therebetween. A thumb and forefinger may be placed into depressions, otherwise described as thumb and forefinger receptacles, in the top of the housing of the lid so that the paint roller handle held between the protrusions may be grasped by placing the thumb and forefinger into the thumb and forefinger receptacles.

DETAILED DESCRIPTION OF THE PREFERRED EMBODIMENT

Figure 1:
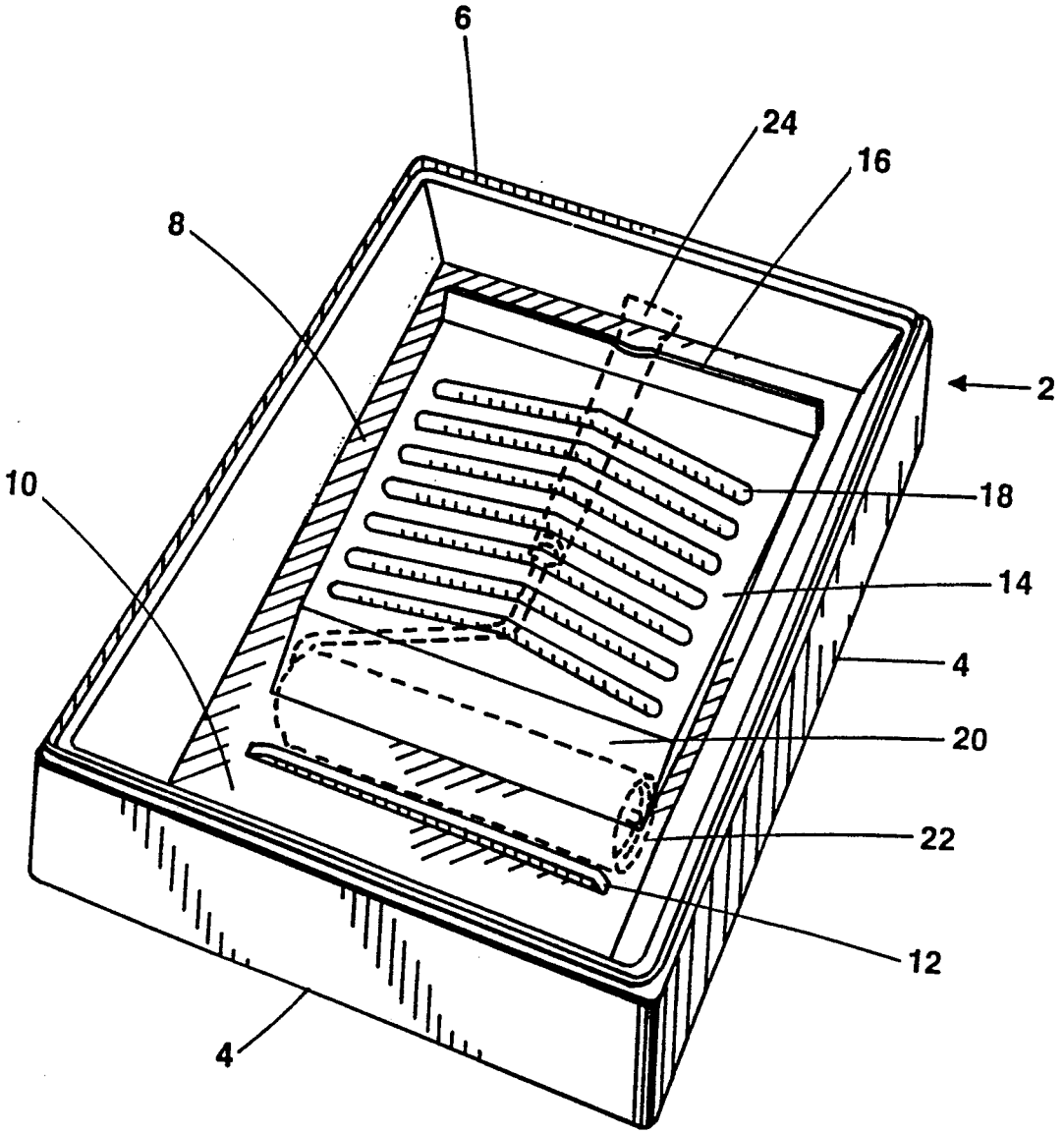
FIG. 1 is a perspective view of the paint roller tray of the present invention.

With reference to FIG. 1, paint tray 2 has tray sides 4 and, extending upwardly from the upper surface of tray sides 4 and continuously around the circumference thereon, continuous flange 6. Paint tray 2 has bottom surface 8 forming at one end of paint tray 2 trough 10. Raised from bottom surface 8 and extending across trough 10 so as to generally bisect trough 10 is ridge 12. Bottom surface 8 slopes gently upwardly from trough 10 along with length of tray 2. Raised above the gently upwardly sloping surface of bottom 8 is raised surface 14 which extends between trough 10 and ledge 16. Raised surface 14 also slopes upwardly from trough 10.

Raised surface 14 is generally planar but may have raised chevrons 18 thereon.

In use, paint (not shown) is poured into trough 10. Conventional paint roller 20 (shown in outline), which is of the type conventionally used by lay consumers, having at one end paint applicator sleeve 22 and at its' other end handle 24, may be rested in tray 2 by resting applicator sleeve 22 against ridge 12 and resting handle 24 on ledge 16. Ledge 16 may have a notch as illustrated in FIG. 1 for ease of centering handle 24 on ledge 16. If paint roller 20 is of the type typically used by professional painters, that is, it has a longer handle than the type typically sold to consumers, then applicator sleeve 22 rests on the other side of ridge 12 than as depicted in FIG. 1.

When more paint has to be added to applicator sleeve 22, applicator sleeve 22 is dipped in the paint in trough 10 and again the excess is removed by drawing applicator sleeve 22 over raised chevrons 18 on raised surface 14. Raised surface 14 is dimensioned so that paint on the outer ends of the roller is free to run off into the tray. This prevents the build up of excess paint near the ends which can cause streaking with lower quality paints.

When a particular paint job is completed and the painter wishes to transport the paint tray 2 containing the paint in trough 10 to a new job-site, it is apparent that if paint roller 20 is left resting in the position illustration in FIG. 1 that if it is jarred during transport that applicator sleeve 22 may roll over ridge 12 thereby allowing handle 24 to come into contact with raised surface 14. Thus, wet paint on raised surface 14 would transfer to handle 24. Further, if paint tray 2 is jarred, then paint stored in trough 10 may spill over sides 4.

Figure 2:
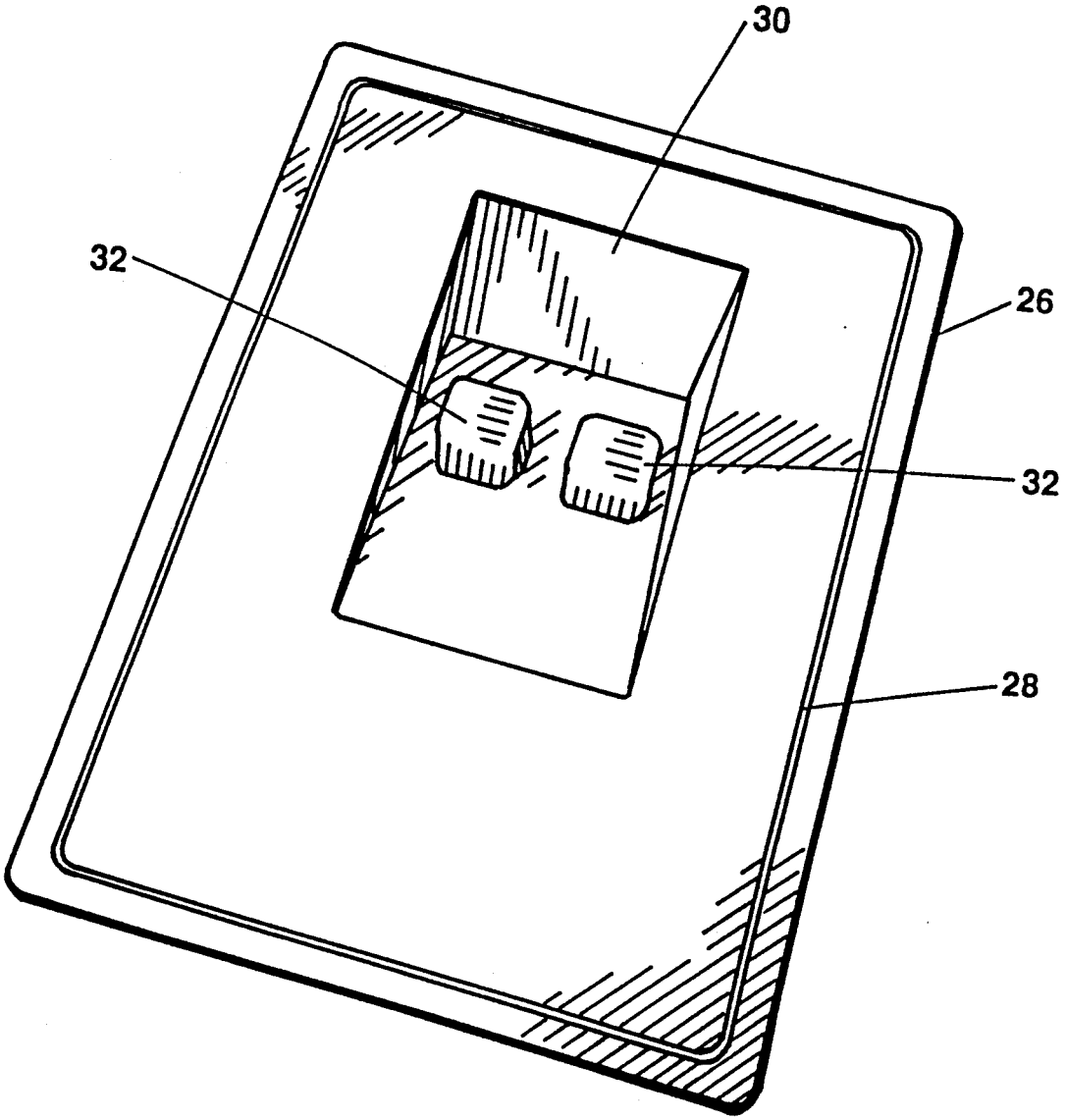
FIG. 2 is a perspective view of the paint roller tray lid of the present invention.

FIG. 2 illustrates paint tray lid 26. Prior to transporting paint tray 2 which contains paint in trough 10 and roller 20 to a new job-site, lid 26 is securely fitted onto tray 2 by mating continuous flange 6 into corresponding continuous groove 28. Paint tray 2 and lid 26 are manufactured of a sufficiently resilient material and flange 6 is a sufficiently snug fit in groove 28 so that an airtight seal is formed when lid 26 is mated onto tray 2 by mating groove 28 with flange 6.

Figure 3:
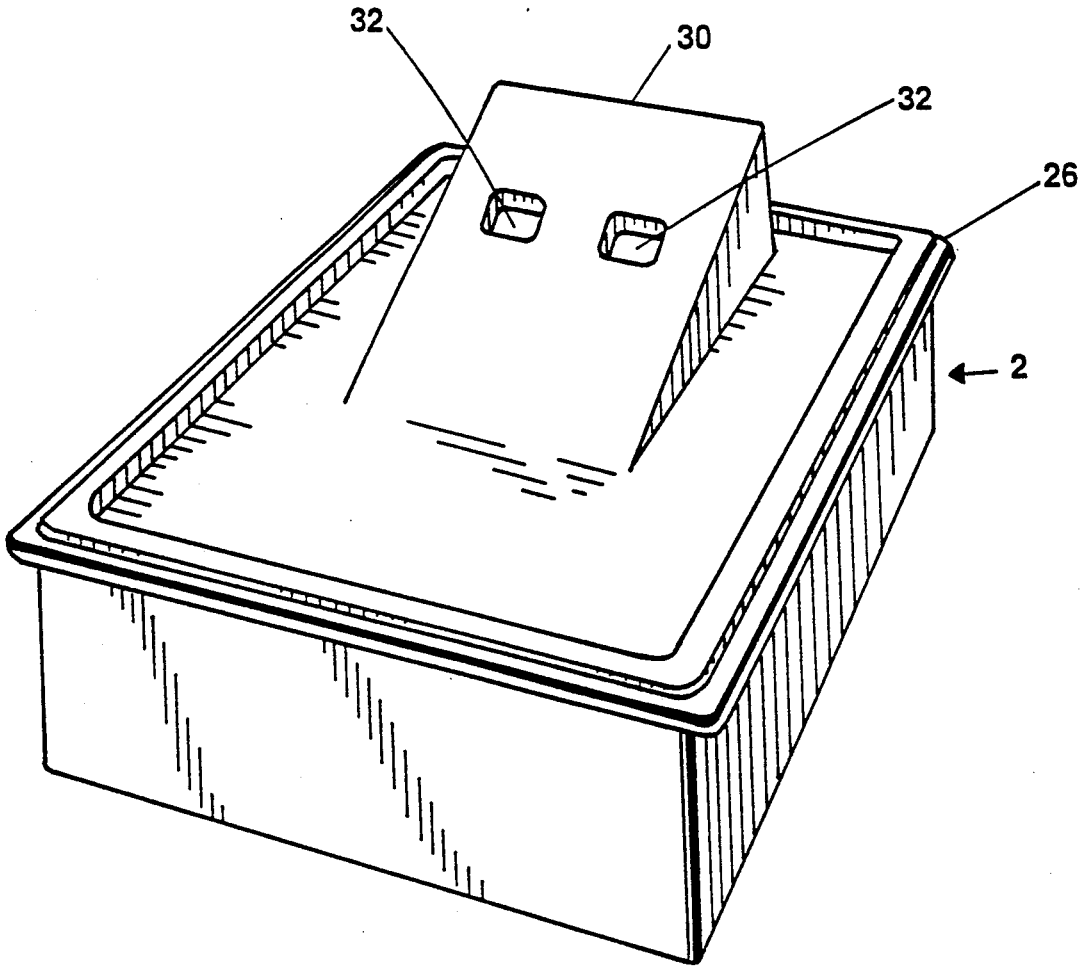
FIG. 3 is a perspective view of the paint roller tray of the present invention having the paint roller tray lid mounted thereon.

FIG. 3 illustrates lid 26 mated onto paint tray 2. Lid 26 has paint roller handle housing 30 formed thereon. When lid 26 is mated onto tray 2, housing 30 forms a cavity over raised surface 14 and ledge 16. Protrusions 32 extend into the cavity formed by housing 30. Protrusions 32 may be columnar having generally rectangular cross section. Protrusions 32 are spaced sufficiently far apart as to accept in snug retention therebetween a paint roller handle 24 of conventional diameter.

Additionally, because of the resilient nature of the materials from which lid 26 is manufactured, protrusions 32 are also resilient so as to accept in snug retention there-between handle 24 of varying diameters.

In use, when it is desired to mate lid 26 onto tray 2, lid 26 may be grasped by placing thumb and forefinger into the depressions in the top surface of housing 30 corresponding to protrusions 32 and pinching housing 30 there-between. Lid 26 is then brought into general proximity to tray 2 and paint roller handle 24 is elevated so as to mate handle 24 between protrusions 32. Because of the resilient nature of protrusions 32, pressure may be applied between protrusions 32 by tightening the grip between the user's thumb and forefinger grasping the lid so as to hold handle 24 securely in place between protrusions 32 while lid 26 is lowered onto paint tray 2. Once lid 26 has been securely mated onto paint tray 2, the user may let go of lid 26 by removing thumb and forefinger from protrusions 32 and handle 24 will be snugly retained between protrusions 32 in a position elevated above raised surface 14.

With handle 24 retained between protrusions 32 and applicator sleeve 22 resting against ridge 12, roller 20 generally will not move in relation to paint tray 2 during the jarring associated with normal transport.

It has been found that if protrusions 32 are set in sufficiently close proximity to the side walls of housing 30 then the spaces between protrusions 32 and the side walls of housing 30 may be used to retain the handles of a pair of paint brushes (not shown) so that a pair of paint brushes may also be transported without the necessity of cleaning the brushes prior to transport or leaving the paint brushes lying partly on raised surface 14 and partly submerged in the paint contained in trough 10.

It is understood that the shape of housing 30 does not necessarily have to be as depicted in FIGS. 2 and 3 so long as paint roller handle 24 way be clipped or otherwise fastened in some fashion to an upper surface of lid 26 which is elevated above raised surface 14.

It is also understood that the manner of forming an airtight seal between lid 26 and tray 2 does not necessarily have to be as illustrated in FIGS. 1 and 2. For example, flange 6 could be on lid 26 and groove 28 could be in the upper surface of sides 4 on paint tray 2. Alternatively, lid 26 could be sized so as to fit snugly entirely within the inner circumference of flange 6, or for that matter the inner circumference of sides 4, so as to provide an airtight seal by friction fit rather than by the flange and groove arrangement depicted. Alternatively, lid 26 could have sides depending therefrom, with dimensions corresponding to sides 4 on paint tray 2, whereby lid 26 would form a cover which could be snugly placed over paint tray 2 including sides 4 so as to thereby form an airtight seal. Groove 28 is preferred on the lid 26 so as to reduce the risk of any mis-poured paint filling the groove resulting in a more time consuming clean-up being required.

The configuration of the present invention as depicted in FIGS. 1–3 is such that tray 2 and lid 26 can be conveniently manufactured using a vacuum molding process.

It should be understood also that any reference herein to paint should be taken to include not only paint but also latex contact cement and any other fluids which may be applied by a roller applicator such as roller 20.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paint roller tray and lid comprising:

sealing means for resealable air-tight mating of said lid with said paint roller tray;

means for detachably securing a paint roller handle when said lid is mated onto said tray;

said lid being formed with a housing wherein said means for detachably securing a paint roller handle comprises a first resilient protrusion and a second resilient protrusion depending from said housing, said protrusions being in spaced apart relation so as to snugly receive therebetween said paint roller handle;

wherein said housing has contiguous sides extending upward from an upper surface of said lid and a roof extending between said contiguous sides, said contiguous sides and said roof defining a cavity, said protrusions depending from said roof into said cavity; and wherein said first resilient protrusion has therein first receptacle extending into said first protrusion for insertion therein of a finger or thumb, and wherein said second resilient protrusion has therein a second receptacle extending into said second protrusion for insertion therein of a finger or thumb, whereby said protrusions may be resiliently deformed by said finger or thumb in said receptacles acting in conjunction so as to grip said paint roller handle between said protrusions.

* * * * *